US005387837A

United States Patent [19]

Roelevink et al.

[11] Patent Number: 5,387,837

[45] Date of Patent: Feb. 7, 1995

[54] LOW-PRESSURE DISCHARGE LAMP AND LUMINAIRE PROVIDED WITH SUCH A LAMP

[75] Inventors: Bauke J. Roelevink, Roosendaal; Paulus Q. J. Nederpel, Eindhoven; Franciscus A. S. Ligthart, Roosendaal, all of Netherlands

[73] Assignee: U.S. Philips Corporation, New York, N.Y.

[21] Appl. No.: 25,300

[22] Filed: Mar. 2, 1993

[30] Foreign Application Priority Data

Mar. 27, 1992 [EP] European Pat. Off. ..... 92200875
Sep. 2, 1992 [EP] European Pat. Off. ..... 92202656

[51] Int. Cl.[6] ..... H01J 19/72; H01J 61/24; H01J 61/30

[52] U.S. Cl. ..... 343/484; 313/493; 313/514; 313/515; 313/573; 313/634; 313/643; 313/545; 313/546; 445/70; 445/73; 445/26; 445/38; 445/53

[58] Field of Search ..... 313/484, 493, 515, 514, 313/112, 116, 573, 634, 643, 623, 624, 625, 545, 546, 550, 566, 564; 445/70, 73, 26, 38, 53

[56] References Cited

U.S. PATENT DOCUMENTS

| | | | |
|---|---|---|---|
| 1,680,633 | 8/1928 | Peters | 313/514 |
| 2,201,390 | 5/1990 | Delaney | 313/493 |
| 2,433,218 | 12/1947 | Herzog | 176/122 |
| 3,913,999 | 10/1975 | Clarke | 313/546 |
| 3,974,410 | 8/1976 | Collins et al. | 313/565 |
| 3,983,439 | 9/1976 | Blommerde et al. | 313/546 |
| 4,035,682 | 7/1977 | Bubar | 313/565 |
| 4,156,550 | 5/1979 | Furukubo et al. | 445/53 |
| 4,437,039 | 3/1984 | Larson | 313/625 |
| 4,975,620 | 12/1990 | Masui et al. | 313/624 |
| 5,055,738 | 10/1991 | Yorifuji et al. | 313/493 |
| 5,090,931 | 2/1992 | Shiraishi | 445/26 |

FOREIGN PATENT DOCUMENTS

| | | | |
|---|---|---|---|
| 61670 | 5/1955 | France . | |
| 2034629 | 6/1973 | Germany | 313/490 |

*Primary Examiner*—Donald J. Yusko
*Assistant Examiner*—Matthew J. Esserman
*Attorney, Agent, or Firm*—William L. Botjer

[57] ABSTRACT

A low pressure discharge lamp having a tubular discharge vessel (1). At each of its end portions (2, 3) the vessel (1) is fused to a respective metal tube (5) having an uncovered outer surface outside the vessel. A sealed glass tube (6) is fused to the metal tubes (5). Ignition aids (18, 28, 40) may also be present. The simple construction of the lamp permits manufacture and high lamp quality, even at long lengths and/or small diameters of the discharge vessel. The lamp may have an ionizable filling of rare gas or may also contain mercury. A fluorescent powder may also be present in the discharge vessel. The lamp (72) and a luminaire (70, 71) mounting the lamp may be used for display or signalling purposes.

19 Claims, 3 Drawing Sheets

LOW-PRESSURE DISCHARGE LAMP AND LUMINAIRE PROVIDED WITH SUCH A LAMP

BACKGROUND OF THE INVENTION

The invention relates to a low-pressure discharge lamp comprising

- a tubular glass lamp vessel which is closed in a vacuumtight manner and has end portions;
- a cylindrically curved metal body to which an end portion of the lamp vessel is fused and which has an exposed outer surface outside the lamp vessel;
- an ionizable filling comprising rare gas in the lamp vessel.

The invention also relates to a luminaire provided with such a lamp.

Such a low-pressure mercury discharge lamp, which is a mercury vapour fluorescent lamp, is known from U.S. Pat. No. 2,433,218.

In the known lamp, the two end portions of the lamp vessel are fused to a metal bush which has its bottom outside the lamp vessel. The moment the lamp vessel is fused to the bushes, the lamp vessel is closed in a vacuumtight manner. Impurities must have been removed from the lamp vessel at that moment and the desired gas filling must be present therein. Cleaning of the lamp vessel, providing the gas filling and at the same time keeping the relevant bush in position relative to the lamp vessel during fusion thereof are difficult and require complicated equipment. The degree of difficulty of the lamp manufacture is higher in proportion as the lamp vessel is longer and/or narrower.

The cylindrically curved metal body of the known lamp has a complicated shape and has portions which are narrowed relative to the portion to which the lamp vessel is fused, both inside and outside the lamp vessel. The internal narrowed portion functions as a hollow electrode during operation. Alternative bodies are assembled from various pans, for example, a cup-shaped pan and a cylinder on the bottom thereof.

SUMMARY OF THE INVENTION

It is an object of the invention to provide a low-pressure discharge lamp of the kind described in the opening paragraph which is of a simple construction and which can be easily manufactured.

According to the invention, this object is achieved in that the metal body is a tube to which a glass tube is fused, which glass tube has a seal.

The low-pressure discharge lamp may have an ionizable filling of one or more rare gases such as, for example, neon, xenon, neon/helium, to which mercury may be added. If mercury is present, argon or neon/argon may alternatively be used. An inner surface between the end portions may be provided with a fluorescent material, for example, when mercury or xenon is present in the filling.

The low-pressure discharge lamp according to the invention can be assembled while the pans to be assembled are accessible from the outside. Thus the lamp vessel, which may be coated with fluorescent powder at the inner surface, may be joined together with one or two metal tubes which, for example, have already been fused to a glass tube, and may then be fused to this metal tube or tubes. The parts to be assembled may be held during this procedure in any location.

The assembled product may subsequently be divested of impurities, for example, through heating, for example, while being flushed with a gas, for example, with air. The lamp vessel may then be closed at a first end, possibly after being flushed with an inert gas, for example, if it had been flushed with air initially. The lamp vessel may be closed at this end, for example, in that the relevant end portion is sealed by fusion. A conductor may then be applied against this end portion or around this end portion in the operational condition of the lamp so as to achieve a capacitive coupling to a supply unit. In a favorable embodiment, however, a metal tube may be present at the said first end to which metal tube a glass tube is fused. In that case the lamp vessel is closed at this end in that this glass tube is sealed. The glass tube may, for example, be capillarized in a usual manner and subsequently closed. Alternatively, however, the tube may be closed by pinching.

The product may then be held at the still open second end by the relevant glass tube, which acts as an exhaust tube, and the lamp vessel may then be provided with its gas filling through this glass tube and subsequently be sealed off from the surroundings in that the glass tube is provided with a seal, for example, by fusion or pinching in an area between the metal tube and the location where the glass tube is held.

The low-pressure discharge lamp according to the invention as a result has a simple construction and can be readily manufactured. The discharge vessel may be long, if so desired, while nevertheless the lamp is of a high quality. The construction of the lamp in fact renders it possible to clean the lamp thoroughly during its manufacture. Impurities which adversely affect the life or the light output of the lamp can be avoided by this.

The construction is favorable not only for a lamp vessel of great length, but above all also for a lamp vessel of a small internal diameter, for example 1.5 to 7 mm, because of the ease of its manufacture and its simplicity, and because of the ease of cleaning the lamp vessel, since flushing remains possible up to the moment at which a first end is sealed. The shape of the metal tube, which requires little width, and which acts as an electrode and as a current lead-through for this electrode and as a connection contact for a supply source and as an extension piece for an exhaust tube, renders small internal lamp vessel diameters possible. If so desired, the metal tube may have different diameters inside and outside the lamp vessel.

The lamp vessel may be of rectilinear shape or may be bent, for example, into a zigzag or meander shape. Bending of the lamp vessel starting from a straight tube may take place prior to, during, or after assembly, for example, with the finished lamp.

The low-pressure discharge lamp, for example, a low-pressure mercury discharge lamp or a low-pressure xenon discharge lamp, may be used, for example, for creating decorative lighting, for example, line lighting or linear safety lighting, or for illumination through a panel, for example, a panel for the display of, for example, alpha-numerical information, or it may be used as a signal lamp. The low-pressure discharge lamp comprising a filling of rare gas may be used, for example, as a signal lamp, for example, as a traffic-light lamp or in/at vehicles.

It is an advantage of the low pressure discharge lamp with an ionizable rare gas filling, in which accordingly mercury plays no pan in the generation of light, that the response to triggering of the lamp is fist. Thus a lamp with an ionizable filling of predominantly neon may be used for generating red light, for example, tail light, stop light, red traffic light.

An incandescent lamp for operation at low voltage, for example 12 V, requires approximately 300 ms after triggering in order to produce its full luminous flux. At a speed of 100 km/h a vehicle moves forward 8.3 m in that period. The low-pressure discharge lamp with an ionizable filling of rare gas emits its full luminous flux alter less than approximately 10 ms, in contrast to an incandescent lamp and to a low-pressure discharge lamp comprising mercury as the main component of the ionizable filling, because mercury must first evaporate before it starts emitting. When the lamp of the invention is used as a stop light lamp in a vehicle, a vehicle coming from behind at 100 km/h accordingly has an approximately 8 m longer brake path available.

In some motor vehicles, a lamp with two incandescent bodies, of 5 W and 21 W, is used for providing the tail light and the stop light, respectively. One lamp according to the invention with neon as the ionizable filling can perform both functions because the lamp can be operated at different powers without the color point of the generated light being substantially affected by this. In addition, the lamp is up to four times more efficient than an incandescent lamp giving the same luminous flux, also because the lamp requires no filter, in contrast to an incandescent lamp, in order to radiate light of the correct color point for this purpose. This is important for the power, and thus for the dimensions and mass of the dynamo to be incorporated in a vehicle.

It is favorable if the lamp vessel of a rare gas discharge lamp has a comparatively small internal diameter, for example $3.5 \pm 1.5$ mm. The lamp may then have a comparatively high luminance, especially in the case of a filling pressure of approximately 10 to approximately 40 mbar, more in particular approximately 30 to approximately 40 mbar, when the diameter has a comparatively small value in the said range. Example: with an internal diameter of 3.5 mm, a filling pressure of 15 mbar neon, and a current rating of 10 mA, the lamp has a luminance of approximately 7500 cd/m$^2$. Substantially proportional higher luminances of up to a few tens of thousands cd/m$^2$ are achieved at higher current strengths.

A lamp with a neon/helium filling may be used as an indicator lamp or as an amber traffic-light lamp. A lamp with xenon as the ionizable gas may be used, for example, as a reversing light lamp or as some other white signal lamp. The lamp may comprise fluorescent material for converting generated UV radiation into visible radiation and add the latter to the white light directly generated. The fluorescent material may alternatively be, for example, green-emitting, for example zinc silicate activated by manganese (willemite), so that the lamp is suitable for use as a green traffic-light lamp.

Another advantage of the low-pressure discharge lamp according to the invention is that the lamp may have a small diameter and, if so desired, a small length, so that a luminaire in which the lamp is accommodated can be flat. Such a luminaire is suitable for being mounted against the rear of a vehicle as a signalling luminaire. Alternatively, the luminaire may be used, for example, on motorways for displaying important information such as warnings, prohibitions, speed limits, and the like. One lamp may then form an entire symbol or picture by radiating through a window comprising the shape of that symbol or picture. Alternatively, one lamp may be a portion of a symbol on account of its own shape, for example, a red circle or triangle or a portion thereof, while another lamp represents, for example, a white number, a line, or a dot thereof.

The electrode described is a cold electrode. This may require a comparatively high voltage for lamp ignition. In a favorable embodiment of the low-pressure discharge lamp according to the invention, a glass tube has a seal which comprises a fusion of this tube with a second metal tube and a closed second glass tube which is fused to this second metal tube at a distance from the former glass tube. A comparatively low voltage of, for example, 180 V may then be applied between the two metal tubes at the relevant lamp vessel end, so that ionization is generated owing to which the lamp will readily ignite on a simpler supply. The current between the two tubes may be limited, for example, by a conventional resistor, for example, of 40 kOhms. It is true that the number of lamp components has increased in this embodiment, but the simplicity and ease of manufacture of the lamp is not impaired by this. If so desired, the lamp has such a provision at both ends of the lamp vessel.

In a modification of this embodiment, the lamp is constructed as a multiple lamp, for example, as a twin lamp. In the case of a fluorescent lamp, the first glass tube is then also coated with fluorescent powder, so that fluorescence occurs during operation also in that location. This modification is favorable, for example, when the impedance of a lamp of single construction would come close to the impedance to earth. This would render it difficult to dim the lamp during high-frequency operation because the impedance during dimming increases still further and could exceed the impedance to earth. The lamp would extinguish then. The said modification also offers the possibility of igniting one portion of the lamp while another portion is not ignited. The lamp may fulfil a signal function in addition as a result of this.

The two metal tubes at one lamp end may be at a distance from one another in longitudinal direction, but alternatively the second metal tube may project into the first one. The distance between the two tubes may be chosen to be very small in that case. The lamp offers the possibility of choosing the distance between the two metal tubes at will.

In another modification, the two metal tubes at one end of the lamp vessel are interconnected inside the lamp vessel by means of a, for example coiled, metal wire. This wire may be provided with an emitter. When a voltage is applied across this wire, a hot electrode is obtained which readily forms an emitter.

In another embodiment, the metal tube to which an end portion of the lamp vessel is fused, is longitudinally divided and the glass tube is present in the divided metal tube. In this embodiment, the glass tube is fused to the metal tube and to the lamp vessel. This embodiment has the advantage that several conductors may enter the lamp vessel at one end. A glow discharge may be generated between these conductors for igniting the lamp, but alternatively a, for example coiled, wire may be present between these conductors so as to act as a hot electrode.

The luminaire according to the invention comprises a housing with a light-transmitting cover and containing at least one lamp according to the invention, in particular the lamp having at least one rare gas as the ionizable filling. The filling may consist of a single rare gas or alternatively of a mixture of rare gases. It is also possible for the filling to contain in addition mercury. The lamp vessel may have a surface provided with fluorescent material between the end portions, with or without mercury in the filling. The lamp vessel may be bent, for example, into a meander shape, U-shape or zigzag shape. Light-reflecting means may be present in the housing. The cover may have light-scattering and/or light-spreading means, for example, integral therewith. The cover may for this purpose have, for example, a roughened surface, be made of light-scattering material, have prismatic or cylindrical grooves, etc. The cover may be colored, for example, have the color of the surroundings in which the luminaire is used. Thus, the cover may have the color of the coach work if it used in or at a car. The color saturation, however, may be so low that the color of the cover has only little influence on the color of the radiated light.

BRIEF DESCRIPTION OF THE DRAWINGS

Embodiments of the low-pressure discharge lamp according to the invention are shown in the drawings, in which.

DETAILED DESCRIPTION OF THE PREFERRED EMBODIMENT

Figure 1:
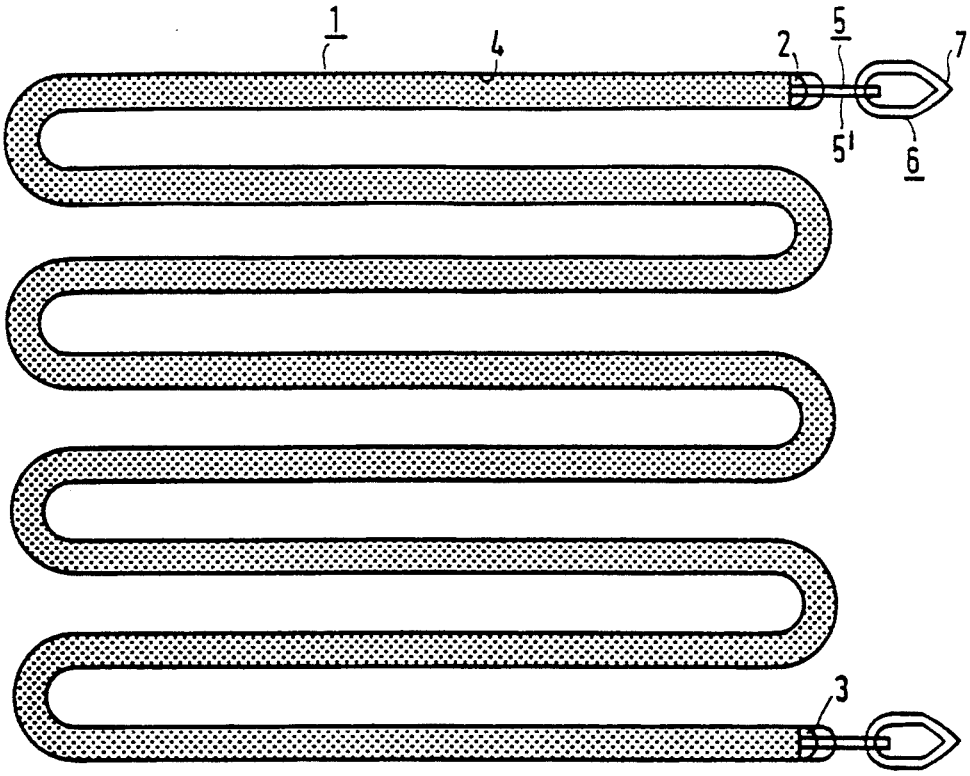
FIG. 1 shows an embodiment in elevation.

In FIG. 1, the low-pressure discharge lamp has a tubular glass lamp vessel 1 which is closed in a vacuum-tight manner, has end portions 2, 3, and has an inner surface. An end portion 2 of the lamp vessel is fused to a cylindrically curved metal tube 5 which has an exposed outer surface 5' outside the lamp vessel. The lamp vessel has an ionizable filling comprising rare gas.

The metal tube 5 (see also FIG. 2) to which a glass tube 6 having a seal 7 is fused.

The lamp vessel shown is bent into a meander shape. The lamp may be used, for example, for radiating through a screen. The lamp vessel has, for example, an internal diameter of 2.6 mm, a wall thickness of 0.8 mm, and a length of 1 m. The lamp vessel may consist of, for example, lime glass to which $CeO_2$ is added as a UV absorber. The glass tube may consist of, for example, lime glass or lead glass. The metal tube may be chosen from metals having a coefficient of thermal expansion which corresponds to that of the glass fused thereto, for example, a CrNiFe alloy, for example, that with 6% by weight Cr, 42% by weight Ni, and the rest Fe. The tube in the Figure has a diameter of, for example, 1.5 mm with a wall thickness of, for example, 0.12 mm. Alternatively, however, the glass of the lamp may be hard glass, for example borosilicate glass, in which case a metal tube of, for example, 29% by weight Ni, 17% by weight Co, and for the rest Fe, or a tube of Ni/Fe may have a suitable coefficient of expansion. The exposed outer surface 5' of the metal tube 5, between the glass tube 6 and the lamp vessel I fused to this metal tube at a distance, may provide an electrical connection of the lamp with a supply source. The lamp shown is free from emitter. Alternatively, however, emitter may be provided in the metal tubes, for example, in that a body which reduces the emission voltage is included in the tube with clamping fit. In making this clamping connection, however, it is possible to keep a passage open for gas.

The lamp shown has a surface coated with fluorescent powder 4 between the end portions.

The lamp was manufactured in that the lamp vessel-to-be, coated with fluorescent powder between its end portions, was fused to metal tubes 5 to which open glass tubes 6 were fused. The assembly was connected to a pump by means of a glass tube 6 and the product was heated while air was passed through it. The assembly was flushed with argon, after which the free tube 6 was sealed. The product was evacuated and provided with the gas filling, in the lamp shown: mercury and 40 mbar Ne/Ar 95/5 by volume, after which the tube 6 connected to the pump was fused against the mr so as to obtain a seal 7.

The lamp shown had a luminous efficacy of 73 lm/W at a power consumption of 4 W.

An alternative embodiment of the lamp shown in FIG. 1 was provided with xenon at a pressure of 40 mbar as the ionizable filling instead of Ne/Ar and mercury, as are other straight and U-shaped lamp vessels. The pressure may alternatively be set for a different value, for example, in the 30 to 160 mbar range.

The lamp vessel and the metal tube may be so dimensioned that the lamp vessel fuses itself to the metal tube sideways. It is favorable, however, to fuse the lamp vessel to the tube by means of an end face of the tubing material from which the lamp vessel is created. When the end portion of the future lamp vessel is heated, it will curve inwards towards the slimmer metal tube, fusing itself to this tube with its end face. The same is true for the glass tube which is sealed to the metal tube and which has the end seal.

In FIG. 1, the tubular shape of the glass tube 6 is still recognizable, but this is not essential. A seal is shown in other Figures which lies so close to the metal tube that the tubular shape of the glass body 6 in which the seal is realized is no longer or scarcely recognizable. It is obvious that this does not detract from the essence of the invention and of the low-pressure discharge lamp according to the invention.

Figure 2:
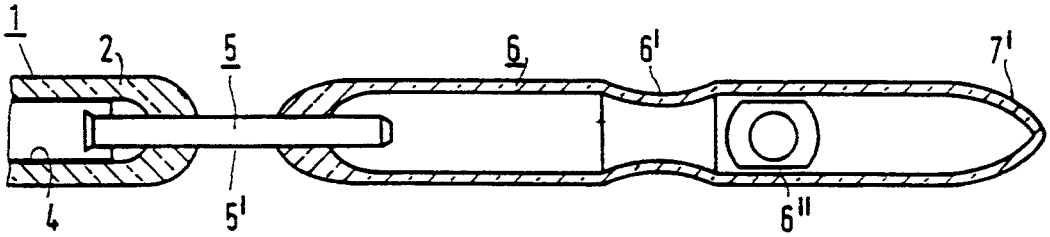
FIG. 2 shows a detail of a modification of FIG. 1 in cross-section.

In FIG. 2, the glass tube 6 comprising the seal 7' is much longer than in FIG. 1. The tube has a constriction 6' which keeps a container 6'' for mercury confined in a position near the seal 7'. The container 6'' may be opened, for example by high-frequency means, while the tube 6 is hot so that the mercury is released from the container and is driven into the lamp vessel. The tube 6 can subsequently be provided with a seal 7 much closer to the lamp vessel 1 so as to obtain the lamp of FIG. 1 ..

Figure 3:
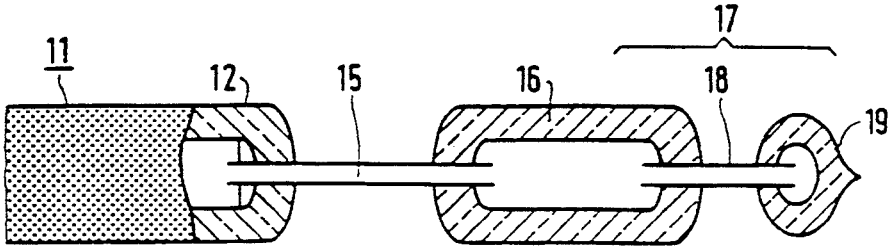
FIG. 3 shows an alternative embodiment in elevation, partly in cross-section.

In FIG. 3, reference numerals denoting corresponding parts are 10 higher than those in FIG. 1, and the glass tube 16 fused to the metal tube 15 at the end portion 12 of the lamp vessel 11 has a seal 17. The seal comprises a fusion of the glass tube 16 to a second metal tube 18, and a closed second glass tube 19 fused to the second metal tube 18 remote from the glass tube 16. A voltage may be applied across the tubes 15 and 18, so that a glow discharge is generated which promotes starting of the lamp. The lamp shown may carry a current of up to the order of some tens, for example, 15 mA.

Figure 4:
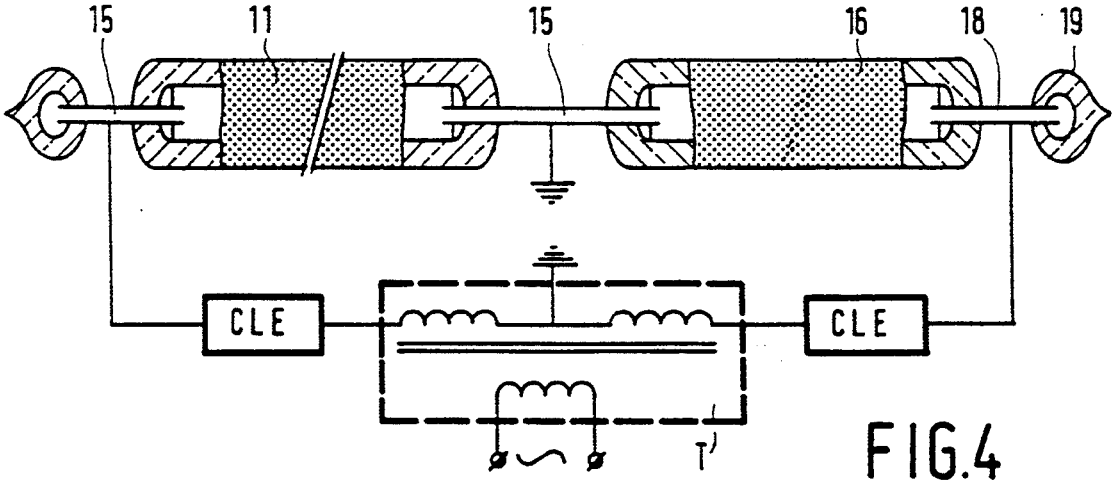
FIG. 4 shows a modification of FIG. 3 in elevation, partly in cross-section.

In FIG. 4, the lamp shown is a dimensional modification of FIG. 3, but this time with a fluorescent powder at the inner surface of the tube 16. The lamp may be fed by a transformer T of which the center of the secondary winding is connected to earth, as is the metal tube 15. Current-limiting elements CLE are connected in series with respective light-emitting sections 11, 16 of the lamp.

Figure 5:
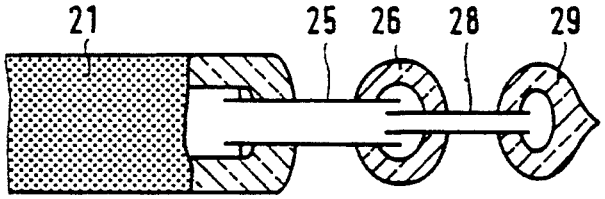
FIG. 5 shows a detail of another modification of FIG. 3.

In FIG. 5, in which reference numerals are 10 higher than those of corresponding parts in FIG. 3, the metal tube 25 surrounds the second metal tube 28, so that the distance between the tubes 25 and 28 is much smaller than that between the tubes 15 and 18 in FIG. 3.

Figure 6:
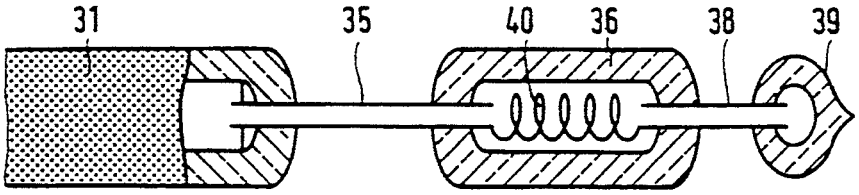
FIG. 6 shows a further modification of FIG. 3.

In FIG. 6, reference numerals of corresponding parts are 20 higher than those in FIG. 3. The metal tube 35 and the second metal tube 38 are interconnected by a metal wire 40 inside the lamp so as to provide a heatable electrode. A voltage of, for example, 9 V may be applied across the wire 40, which may be provided with an emitter, whereupon the wire dissipates a power of 0.3 W. The current through the lamp may be comparatively great, for example, greater than 30 mA.

Figure 7:
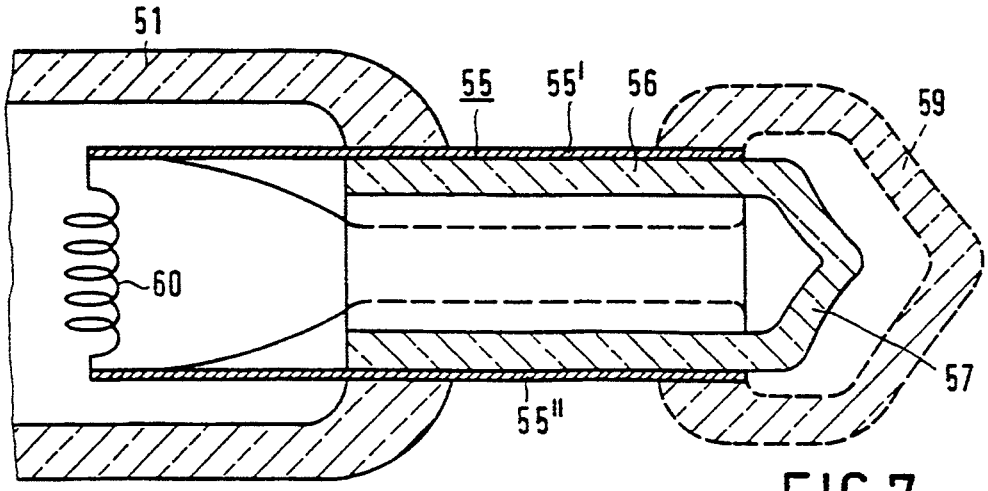
FIG. 7 shows a detail of a further embodiment in cross-section.

Reference numerals in FIG. 7 are 20 higher than those of corresponding parts of FIG. 6. The metal tube 55 is divided longitudinally and a glass tube 56 is present in the tube 55, fused to the metal tube 55 and to the lamp vessel 51. The glass tube has a seal 57. In a modification shown in broken lines, a seal 59 is formed from a separate glass body. The pans 55', 55" of the metal tube 55 each form a current lead-through, inter alia for supplying the incandescent wire 60.

Figure 8:
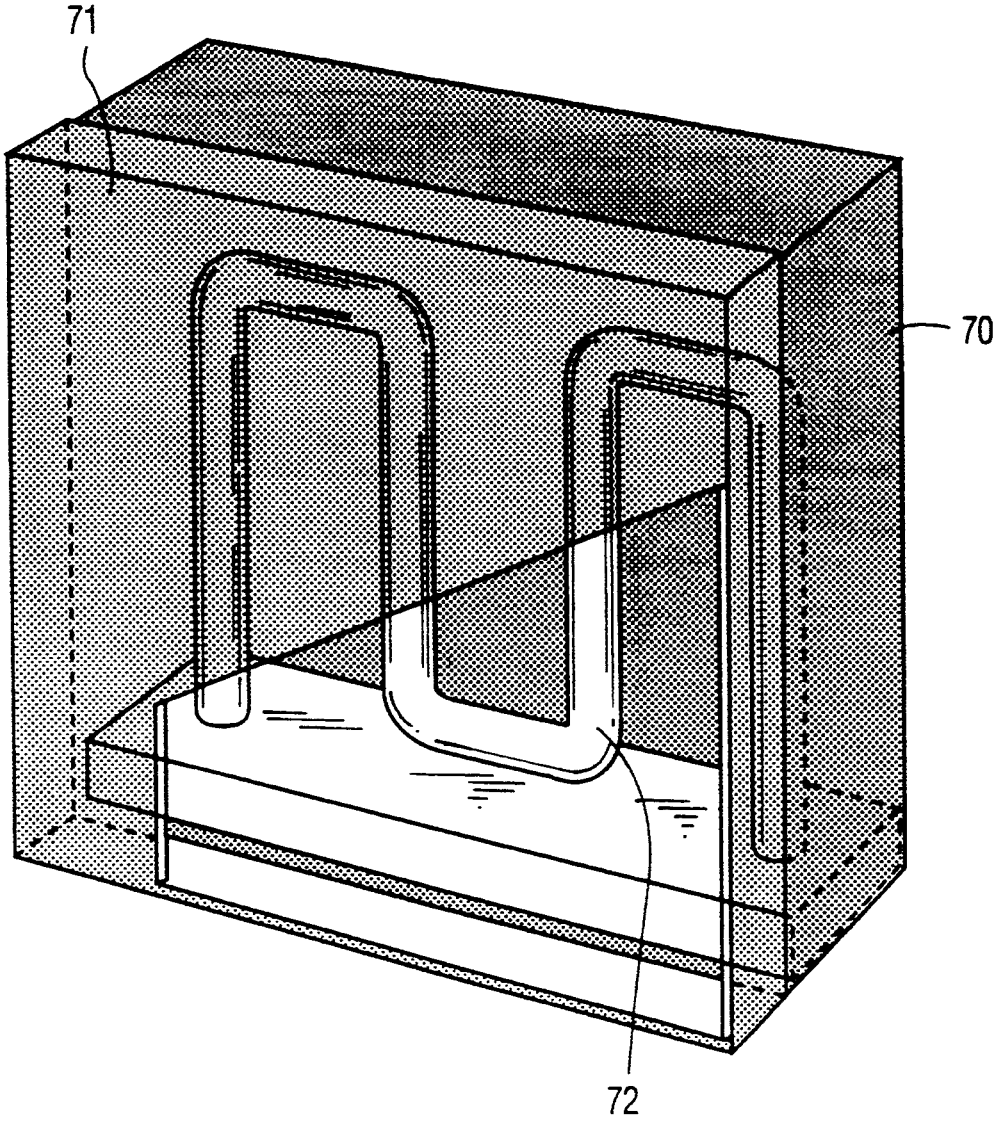
FIG. 8 shows a luminaire according to the invention in perspective view.

In FIG. 8, the luminaire has a housing 70 with a light-scattering cover 71. The lamp 72 according to the invention is present in the housing. The lamp is bent into an M-shape. The lamp vessel has an internal diameter of 3.5 min. The length of the discharge path is 45 cm. The ionizable filling consists of neon at a filling pressure of 15 mbar. The lamp emits the red color required for motorcar tail lights and stop lights and for traffic lights. The lamp dissipates a power of 7 (12) W at a current strength of 10 (20) mA and provides a luminous flux of 90 (160) lm then, which corresponds to a luminous efficacy of 13 (13) lm/W. For operation at a comparatively high current value, the metal tubes 5 (see FIG. 1 ) may each have a cover of, for example, niobium inside the lamp vessel, which cover is fixed to the tube, for example, with spot welds and which keeps a connection between the lamp vessel and the relevant tube open.

We claim:

1. A low-pressure discharge lamp comprising:

a tubular glass lamp vessel which is closed in a vacuumtight manner and has end portions;

a cylindrical metal tube to which an end portion of the lamp vessel is fused and which has an exposed outer surface and an end outside the lamp vessel;

an ionizable filling comprising rare gas in the lamp vessel, a glass tube fused proximate to the end of the metal tube and the glass tube having a seal.

2. A low-pressure discharge lamp as claimed in claim 1, wherein the seal comprises a second metal tube and a closed second glass tube which is fused to the second metal tube at a distance from the glass tube, said second glass tube being sealed.

3. A low-pressure discharge lamp as claimed in claim 2, wherein the glass tube is coated with fluorescent powder.

4. A low-pressure discharge lamp as claimed in claim 2, wherein the metal tube surrounds the second metal tube.

5. A low-pressure discharge lamp as claimed in claim 2, wherein the metal tube and the second metal tube are interconnected inside the lamp by means of a metal wire.

6. A low-pressure discharge lamp as claimed in claim 1 wherein the lamp vessel is fused to a metal tube at each of the end portions, to which metal tubes a respective glass tube having a seal is fused.

7. A low-pressure discharge lamp as claimed in claim 6 wherein lamp vessel has an inner surface which is coated with a fluorescent powder between the end portions and which in addition comprises mercury in the ionizable filling.

8. A luminaire comprising a housing with a light-transmitting cover wherein at least one low-pressure discharge lamp as claimed in claim 1 is present in the housing.

9. A luminaire as claimed in claim 8, wherein at least one low-pressure discharge lamp is present, said lamp having an ionizable filling comprising rare gas.

10. A low-pressure discharge lamp as claimed in claim 1, wherein the lamp vessel is fused to a metal tube at each of the two end portions to which metal tubes a respective glass tube having a seal is fused.

11. A low-pressure discharge lamp as claimed in claim 2, wherein the lamp vessel is fused to a metal tube at each of the two end portions to which metal tubes a respective glass tube having a seal is fused.

12. A low-pressure discharge lamp as claimed in claim 3, wherein the lamp vessel is fused to a metal tube at each of the two end portions to which metal tubes a respective glass tube having a seal is fused.

13. A low-pressure discharge lamp as claimed in claim 4, wherein the lamp vessel is fused to a metal tube at each of the two end portions to which metal tubes a respective glass tube having a seal is fused.

14. A low-pressure discharge lamp as claimed in claim 5, wherein the lamp vessel is fused to a metal tube at each of the two end portions to which metal tubes a respective glass tube having a seal is fused.

15. A low-pressure discharge lamp as claimed in claim 1, wherein the lamp vessel has an inner surface which is coated with a fluorescent powder between the end portions and which in addition comprises mercury in the ionizable filling.

16. A low-pressure discharge lamp as claimed in claim 2, wherein the lamp vessel has an inner surface which is coated with a fluorescent powder between the end portions and which in addition comprises mercury in the ionizable filling.

17. A low-pressure discharge lamp as claimed in claim wherein the lamp vessel has an inner surface which is coated with a fluorescent powder between the end portions and which in addition comprises mercury in the ionizable filling.

18. A low-pressure discharge lamp as claimed in claim 4, wherein the lamp vessel has an inner surface which is coated with a fluorescent powder between the end portions and which in addition comprises mercury in the ionizable filling.

19. A low-pressure discharge lamp as claimed in claim 5, wherein the lamp vessel has an inner surface which is coated with a fluorescent powder between the end portions and which in addition comprises mercury in the ionizable filling.

* * * * *

UNITED STATES PATENT AND TRADEMARK OFFICE

CERTIFICATE OF CORRECTION

PATENT NO. : 5,387,837 
DATED : February 7, 1995
INVENTOR(S) : Bauke J. Roelevink, Paulus Q.J. Nederpel and Franciscus A.S. Ligthart It is certified that error appears in the above-identified patent and that said Letters Patent is hereby corrected as shown below:

Column 8,
Line 13, after "wherein" insert -- the --.
Line 54, after "claim" insert -- 3 --.

Signed and Sealed this

Twenty-ninth Day of October, 2002

*Attest:*

*Attesting Officer*

JAMES E. ROGAN
*Director of the United States Patent and Trademark Office*